United States Patent [19]

Pimiskern

[11] Patent Number: 4,938,781

[45] Date of Patent: Jul. 3, 1990

[54] METHOD OF ORIENTING ELECTRODE TIPS

[75] Inventor: Klaus Pimiskern, Daisendorf, Fed. Rep. of Germany

[73] Assignee: Dornier System GmbH, Friedrichshafen, Fed. Rep. of Germany

[21] Appl. No.: 186,108

[22] Filed: Apr. 25, 1988

[30] Foreign Application Priority Data

Apr. 25, 1987 [DE] Fed. Rep. of Germany ..... 3713884

[51] Int. Cl.[5] ..... H01R 43/00

[52] U.S. Cl. ..... 29/825; 128/24 A; 174/88 C; 219/8.5

[58] Field of Search ..... 29/828, 825; 174/DIG. 8, 88 C; 128/328 S; 219/8.5, 9.5, 10.53

[56] References Cited

U.S. PATENT DOCUMENTS 4,774,947 10/1988 Falk et al. ..... 128/328 S 4,809,682 3/1989 Forssmann et al. ..... 128/328 S X

FOREIGN PATENT DOCUMENTS 288751 11/1988 European Pat. Off. ..... 128/328 S

*Primary Examiner*—Carl E. Hall

*Assistant Examiner*—Carl J. Arbes

*Attorney, Agent, or Firm*—Ralf H. Siegemund

[57] ABSTRACT

A connection is made between inner and outer conductors leading to electrodes to be used for the generation of shock waves for the contact free comminution of concrements (lithotripsy) whereby the inner conductor ends in a tip element and is surrounded by an electrically insulating synthetic sleeve, while the outer conductor is likewise provided with a tip element which is held by a cage that extends from the outer conductor proper; the outer conductor is provided with a plurality of annular grooves and as the metal sleeve is inductively heated synthetic material from an originally underformed insulating sleeve flows into the groove such that an axially immobile connection obtains between the thus inter connected conductors to, thereby, indirectly maintain the desired and gauged spacing between the electrode tip elements.

3 Claims, 1 Drawing Sheet

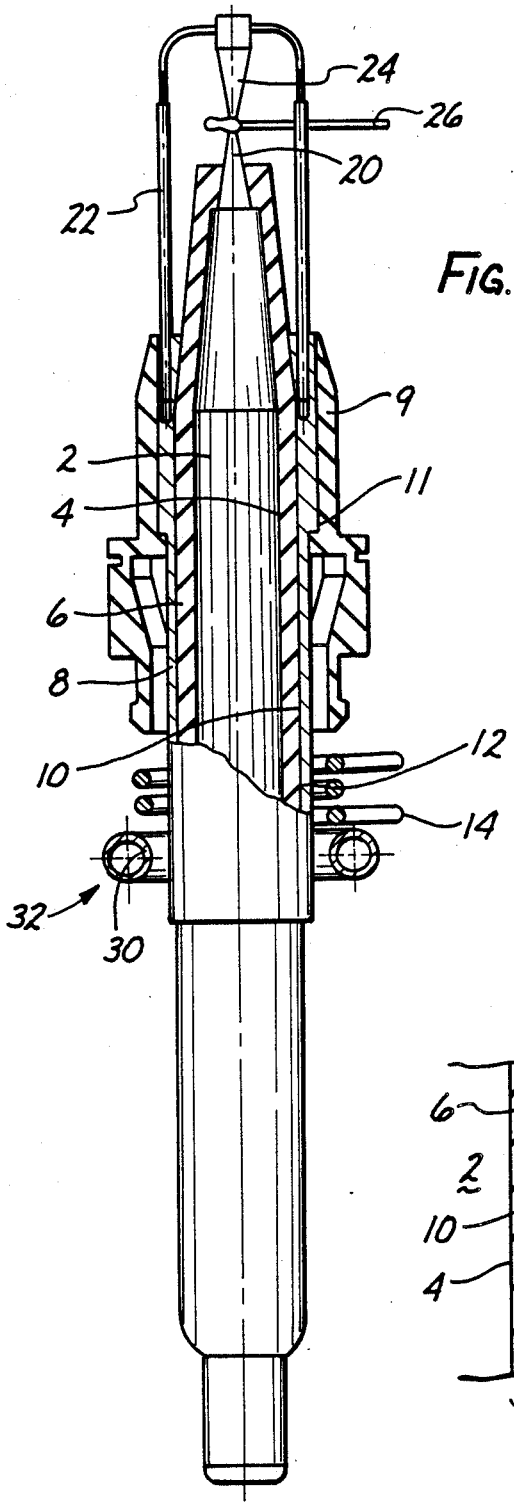
FIG. 1
FIG. 2
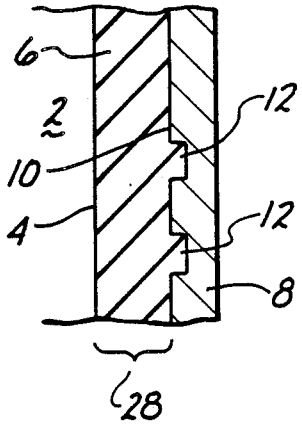

METHOD OF ORIENTING ELECTRODE TIPS

BACKGROUND OF THE INVENTION

The present invention relates to a connection between the electrodes of a pair, such electrodes to be used for the contact-free comminution of concrements in living beings, also called lithotripsy, under utilization of the shock waves which are generated upon a discharge between the electrodes whereby the electrodes themselves are connected to an inner and outer conductor.

Devices and constructions concerning lithotripsy are classified in the international classifications A61, B17-00, and B17/22. A representative example for electrodes, as far as construction is concerned, is shown in German Patent 2,635,635; see also U.S. Pat. Nos. 4,608,983 and 4,809,682 and others.

It is hnown to provide a connection between an inner conductor, an insulation and an outer conductor of such a dual electrode device, the connection is through adhesive bonding. Such adhesive connections, however, are not always adequate and do not hold under all circumstances. One aspect is that they are difficult to test. Also it was found that during transportation or even in use when for some reason or another an impact occurs, the bond may break. Critical here is, particularly, the connection between the jacket of a sleeve-shaped insulation on the inner conductor on the one hand and the bore of and in the outer conductor on the other hand. Since different kinds of thermal expansions occur, the relevant coefficients of the various parts are different, so that during changes in temperature, as is expected to occur during operation, the bond is highly loaded cyclically and may, therefore, break quite easily.

DESCRIPTION OF THE INVENTION

It is an object of the present invention to provide a new and improved connection between an inner and an outer conductor leading to electrodes to be used for the generation of shock waves for the contact free comminution of concrements (lithotripsy) whereby the inner conductor ends in a tip element and is surrounded by an electrically insulating synthetic sleeve, while the outer conductor is likewise provided with a tip element which is held by a cage that extends from the outer conductor proper.

In accordance with the preferred embodiment of the present invention, the objects are attained in that the bore in the metallic, outer conductor is provided with a plurality of annular grooves into which reach (i.e., has flowed) synthetic material from an originally underformed insulating sleeve on the inner conductor, such that an axially immobile connection obtains between the thus inter connected conductors to, thereby, indirectly maintain the desired spacing between the electrode tip elements.

DESCRIPTIONS OF DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

FIG. 1 is an electrode assembly in accordance with the preferred embodiment of the present invention for practicing the best mode thereof in the field of lithotripsy; and FIG. 2 illustrates a detail as indicated in FIG. 1.

Proceeding now to the detailed description of the drawings, FIG. 1 illustrates a cross-section of an electrode as it is used comminution of concrements and being of a basic construction, as far as the electrodes is concerned, such as shown in German Patent Applications P 26 35 635 and 35 43 881, the latter corresponding to U.S. Pat. No. 4,809,682 but see also U.S. Pat. No. 4,608,983 as well as Pending patent application Ser. No. 69,416, filed 07/01/87. The FIG. 1 shows in particular a metallic, inner conductor 2, preferably being made of brass. The inner conductor 2 is provided with an under jacket 4, which in turn carries a sleeve 6 made of a thermoplastic material. For example, polycarbonate traded under the name of "Pocan 1505 Nature."

Another sleeve-shaped outer conductor 8 is provided, made also, for example, of brass or other suitable electrically conductive material. This outer conductor 8 carries another sleeve 9, also made of a synthetic material and being provided for fixing the electrode in a housing. A representative example of a connection is, for example, shown in pending application 917,854 filed 10/14/86, This sleeve 9 envelopes only the frontal part of the outer conductor 8 and is connected thereto in form fitting relationship by operation of a shoulder 11. Conductor 8 has an annular shoulder accordingly.

Outer conductor 8 is provided with a bore 10 which in this particular example is provided with an annular ring or ring shaped groove 12. Assuming that the metal sleeve of the outer conductor 8 was inductively heated, for example through a temporarily placed induction coil 14 using 18 to 30 kilowatts. The sleeve 8, on being heated, will expand owing to the fact that it is made of a synthetic material. In fact, the synthetic material expands more than the surrounding metal so that the gap between the inner conductor 2 and the outer conductor 8 is now sealed.

In the process, some of the synthetic material is forced irreversibly into the ring grove 12. In particular, the synthetic material maintains its position and expansion following cooling. This is so because the extension and expansion exceeded the plastic limit. Following cooling, groove 12, together with the inserted synthetic sleeve material, will provide a certain and positive axial play-free connection between inner conductor 2 and outer conductor 8. This, of course, holds even after the induction coil 14 has been removed.

FIG. 1 illustrates further that the inner conductor 2 is provided to end in a peak, or tip element point 20. The metallic outer conductor 8 carries a second peak or tip element, the carrying being provided by means of a cage 22 which carries the included tip element. The cage construction of suitable configuration is shown in the above referred Pat. No. 4,608,983.

During inductive heating by means of the coil 14, a spacer 26 is temporarily provided between the two tip elements 20 and 24. The spacer will make sure that the electrodes maintain and retain accurate mutual positioning in relation to each other. Owing to this paricular way of fixing the position, as the inner and outer conductor are fixed in relation to each other through the procedure described above, the electrodes and tip elements retain their position as well. Of course, this is the principal purpose of the entire exercise.

FIG. 2 is helpful in understanding the method by means of which the invention is practiced. On inductive heating, the synthetic material 6 expands and abuts the outer sleeve 8. This causes the entire ring gap 28 to be sealed. Upon further heating, particularly in the area of the groves 12 in the outer conductor 8, pressure increases drastically. As the plastic state attains, the material flows into the groves 12 of the conductor 8. After cooling, either actively or just on cessation of inductive heating, positive connection obtains between the synthetic material and its adjoining metallic parts.

In order to limit the plastification in the area of the groove 12, it is suggested to provide actually active cooling immediately following shaving and for this an opening 30 is provided and a cooling device 32, which makes sure that the heat is rapidly removed from the area. This device 32 is also removable after completion of the described process.

The invention offers the following advantage. First of all, there is an axial positive connection between inner and outer conductor, which is adjustable, particularly in dependence upon an adjusted electrode spacing. In this regard, 26 can be termed to be a gauge. The entire arrangement permits higher mechanical loads and will take such a load readily without breakage. Loading occurs particularly between the inner and outer conductor and involves, for example, the production of shock waves. Insulative strength is not compromised; a high voltage of up to 50 kilovolts between the electrodes can be taken up. The particular positive connection between the various parts as described avoids, moreover, the problem of aging and shrinking of the synthetic material.

The invention is not limited to the embodiments described above, but all changes and modifications thereof, not constituting departures from the spirit and scope of the invention are intended to be included.

What is claimed is:

1. A method of particularly orienting electrode tips in relation to each other, to establish a definite locus for the generation of shock waves on electric discharge between the electrode tips, the tips being on tip elements, one element extending from an inner conductor, the other tip element being mounted on a cage that is mounted on an outer conductor, arranged around the inner conductor comprising the steps of:

providing one of the conductors with at least one annular groove;

providing an insulating sleeve as spacer between the inner and the outer conductors;

providing a gauge between the tips of the elements; and heating the sleeve for causing sleeve material to flow into the groove, so that upon subsequent cooling, the inner and outer conductors are axially positioned as determined by the gauge as the solidified material in the groove retains the conductor in the axial position.

2. A method according to claim 1 comprising the step of heating inductively the conductors to thereby heat the sleeve such that the material of the sleeve flows into at least one annular groove.

3. A method of particularly orienting electrode tips in relation to each other, to establish a definite locus for the generation of shock waves on electric discharge between the electrode tips, the tips being on tip elements, one element extending from an inner conductor, the other tip element being mounted on a cage that is mounted on an outer conductor arranged around the inner conductor, comprising the steps of:

providing an outer conductor as a metal sleeve with at least one annular groove;

providing an insulating sleeve as spacer between the inner and the outer conductors;

inductively heating the metal sleeve thereby heating the insulating sleeve for causing insulating sleeve material to flow into the groove, so that upon subsequent cooling, the solidified material in the groove retains the conductor in the axial position and seals the conductors and the insulating sleeve.

* * * * *